US009377728B2

(12) United States Patent
Tokunaga

(10) Patent No.: US 9,377,728 B2
(45) Date of Patent: Jun. 28, 2016

(54) FIXING DEVICE AND IMAGE FORMING APPARATUS

(71) Applicant: KYOCERA Document Solutions Inc., Osaka (JP)

(72) Inventor: Ryohei Tokunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/796,747

(22) Filed: Jul. 10, 2015

(65) Prior Publication Data

US 2016/0026126 A1 Jan. 28, 2016

(30) Foreign Application Priority Data

Jul. 28, 2014 (JP) ..... 2014-152503

(51) Int. Cl.

| | |
|---|---|
| ***G03G 15/20*** | (2006.01) |
| ***H05B 3/00*** | (2006.01) |
| ***H05B 1/02*** | (2006.01) |
| ***H05B 3/42*** | (2006.01) |
| ***H05B 6/06*** | (2006.01) |
| ***H05B 6/14*** | (2006.01) |
| ***H05B 6/36*** | (2006.01) |

(52) U.S. Cl.

CPC ..... *G03G 15/2039* (2013.01); *H05B 1/0202* (2013.01); *H05B 3/0014* (2013.01); *H05B 3/0066* (2013.01); *H05B 3/42* (2013.01); *H05B 6/06* (2013.01); *H05B 6/145* (2013.01); *H05B 6/36* (2013.01); *G03G 15/2003* (2013.01); *G03G 15/2064* (2013.01); *G03G 15/2078* (2013.01); *G03G 15/2082* (2013.01); *G03G 2215/2016* (2013.01); *G03G 2215/2035* (2013.01)

(58) Field of Classification Search

CPC ..... G03G 15/20
USPC ..... 399/33, 320
See application file for complete search history.

(56) References Cited

U.S. PATENT DOCUMENTS

| | | | | |
|---|---|---|---|---|
| 8,131,197 | B2 * | 3/2012 | Hiraoka | G03G 15/206 399/329 |
| 8,855,509 | B2 * | 10/2014 | Fujiwara | G03G 15/2078 399/33 |
| 2007/0014601 | A1 * | 1/2007 | Yasuda | H05B 6/145 399/329 |

(Continued)

FOREIGN PATENT DOCUMENTS

| | | | | |
|---|---|---|---|---|
| JP | 2010-066543 A | | 3/2010 | |
| JP | 2012-002881 | * | 1/2012 | G03G 15/20 |
| JP | 2012-002881 A | | 1/2012 | |

*Primary Examiner* — Clayton E Laballe
*Assistant Examiner* — Kevin Butler
(74) *Attorney, Agent, or Firm* — Studebaker & Brackett PC

(57) ABSTRACT

A fixing device includes a fixing belt, a pressuring member, a heating member, a voltage applying part, a current detecting part, a moving member, a driving mechanism and a controlling part. The voltage applying part applies a heating voltage for heating the fixing belt to the heating member. The current detecting part detects current flowing through the heating member. The moving member is movable between a first position where the current becomes a first value and a second position where the current becomes a second value. The driving mechanism moves the moving member from the first position to the second position in conjunction with a rotation stop of the fixing belt. The controlling part stops the voltage applying part from applying the heating voltage to the heating member in conjunction with a change of the current from the first value to the second value.

9 Claims, 6 Drawing Sheets

(56) References Cited

U.S. PATENT DOCUMENTS

2007/0019063 A1* 1/2007 Yasuda ..... G03G 15/2042 347/223
2014/0241767 A1* 8/2014 Egi ..... G03G 15/2053 399/329
2014/0241768 A1* 8/2014 Egi ..... G03G 15/2017 399/329
2014/0356038 A1* 12/2014 Arai ..... G03G 15/2017 399/329
2014/0376934 A1* 12/2014 Egi ..... G03G 15/205 399/33
2014/0376935 A1* 12/2014 Egi ..... G03G 15/2053 399/33
2014/0376979 A1* 12/2014 Egi ..... G03G 15/2053 399/329

* cited by examiner

FIXING DEVICE AND IMAGE FORMING APPARATUS

INCORPORATION BY REFERENCE

This application is based on and claims the benefit of priority from Japanese patent application No. 2014-152503 filed on Jul. 28, 2014, the entire contents of which are incorporated herein by reference.

BACKGROUND

The present disclosure relates to a fixing device fixing a toner image on a recording medium and an image forming apparatus including the fixing device.

Conventionally, an electrographic image forming apparatus, such as a printer or a copying machine, forms a toner image on a recording medium, such as a sheet, and then, heats and pressures the recording medium and the toner image by a fixing device, thereby fixing the toner image on the recording medium. In recent years, because requests of energy saving and shortening of a warm-up time are increased, reduction of a heat capacity of the fixing device is actively considered.

For example, to achieve the reduction of the heat capacity of the fixing device, there is a fixing device includes a fixing belt, a pressuring member configured to come into pressure contact with the fixing belt so as to form a fixing nip and a heating member configured to heat the fixing belt.

With regard to the fixing device with such a configuration, if the fixing belt in a rotation stop state is locally heated by the heating member, there is a fear that a temperature of a part of the fixing belt is excessively raised and the fixing belt is deformed.

SUMMARY

In accordance with an embodiment of the present disclosure, a fixing device includes a fixing belt, a pressuring member, a heating member, a voltage applying part, a current detecting part, a moving member, a driving mechanism and a controlling part. The fixing belt is configured to be rotatable around a rotation axis. The pressuring member is configured to come into pressure contact with the fixing belt so as to form a fixing nip. The heating member is configured to heat the fixing belt. The voltage applying part is configured to apply a heating voltage for heating the fixing belt to the heating member. The current detecting part is configured to detect current flowing through the heating member. The moving member is configured to be movable between a first position where the current flowing through the heating member becomes a first value in a state that the voltage applying part applies the heating voltage to the heating member and a second position where the current flowing through the heating member becomes a second value in the state that the voltage applying part applies the heating voltage to the heating member. The driving mechanism is configured to move the moving member from the first position to the second position in conjunction with a rotation stop of the fixing belt. The controlling part is configured to stop the voltage applying part from applying the heating voltage to the heating member in conjunction with a change of the current detected by the current detecting part from the first value to the second value in the state that the voltage applying part applies the heating voltage to the heating member.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
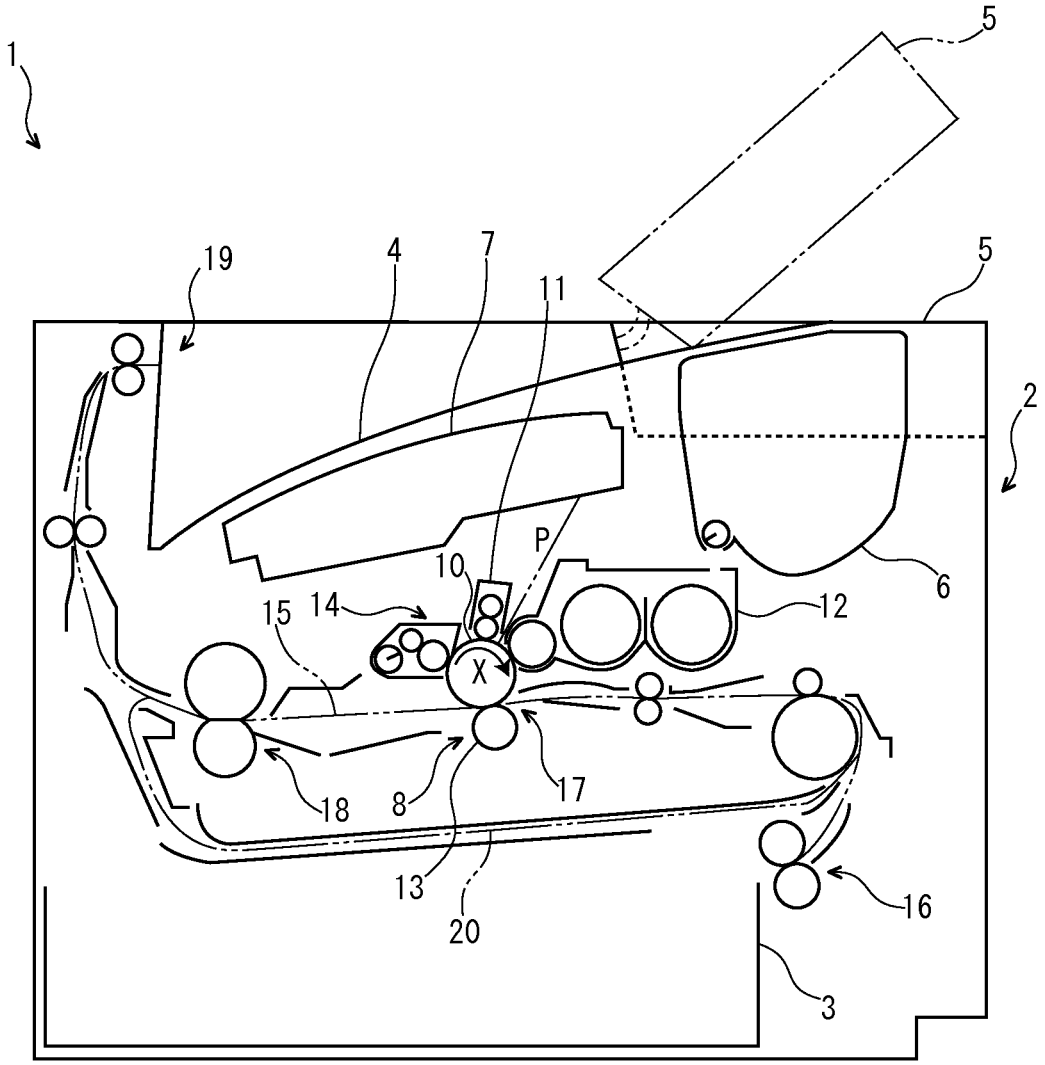
FIG. 1 is a schematic view showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner.

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described.

Hereinafter, a near side of FIG. 2 will be described as a front side of the fixing device 18, for convenience of explanation. Arrows Fr, Rr, L, R, U and Lo of each figure indicate a front side, a rear side, a left side, a right side, an upper side and a lower side of the fixing device 18, respectively. An arrow Y of FIG. 2 indicates a conveying direction of the sheet. An arrow I of FIG. 3 indicates an inside in a front and rear direction and an arrow O of FIG. 3 indicates an outside in the front and rear direction.

Figure 2:
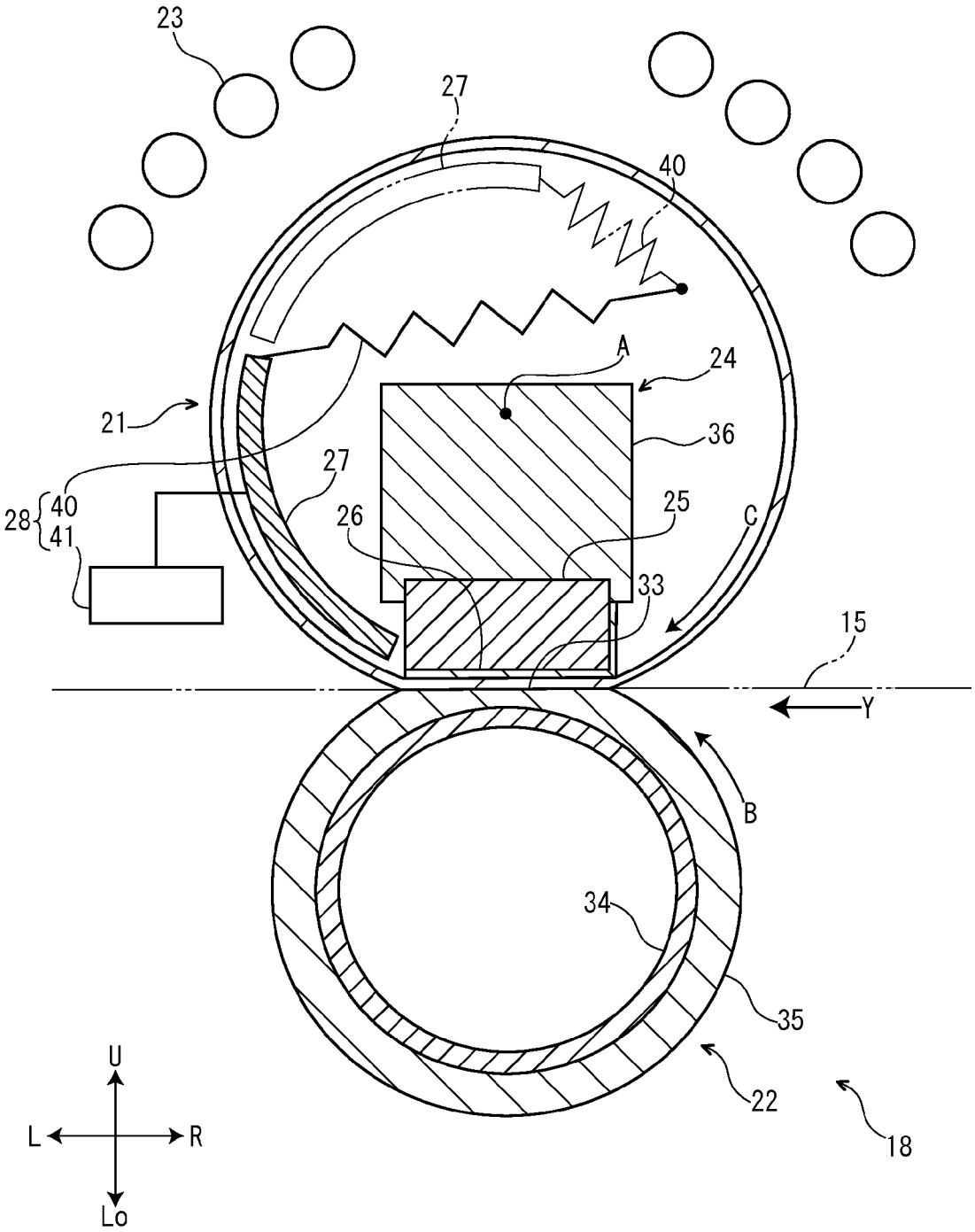
FIG. 2 is a sectional view showing a fixing device according to the embodiment of the present disclosure.
Figure 3:
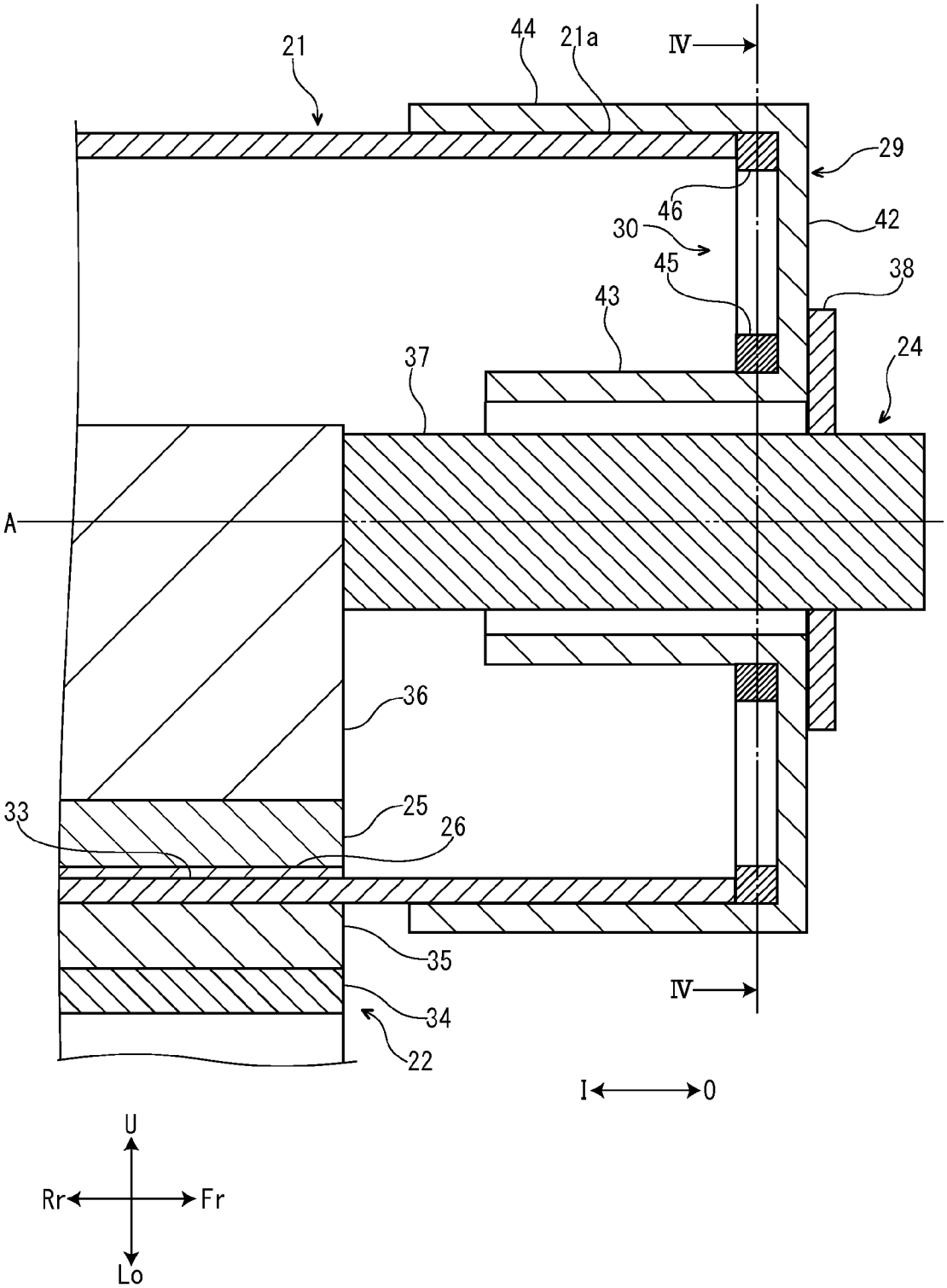
FIG. 3 is a sectional view showing a front end part of the fixing belt and its periphery in the fixing device according to the embodiment of the present disclosure.

As shown in FIGS. 2-3 and other figures, the fixing device 18 mainly includes a fixing belt 21, a pressuring roller 22 (a pressuring member) arranged at a lower side (an outer diameter side) of the fixing belt 21, an excitation coil 23 (a heating member) arranged at an upper side (an outer diameter side) of the fixing belt 21, a supporting member 24 arranged at an inner diameter side of the fixing belt 21, a pressing pad 25 (a pressing member) arranged at an inner diameter side of the fixing belt 21 and at a lower side of the supporting member 24, a sheet member 26 arranged at an inner diameter side of the fixing belt 21 and at right and lower sides of the pressing pad 25, a moving member 27 arranged at an inner diameter side of the fixing belt 21 along an inner circumferential face of the fixing belt 21, a driving mechanism 28 connected with the moving member 27, front and rear bias stopping members 29 (see FIG. 3) respectively attached to both front and rear end parts 21*a* (only the front end part 21*a* is shown in FIG. 3) of the fixing belt 21 and a switching mechanism 30 (see FIG. 3) attached to the front bias stopping member 29. Incidentally, the bias stopping members 29 and the switching mechanism 30 are omitted in FIG. 2.

The fixing belt 21 is rotatable around a rotation axis A extending in the front and rear direction. That is, in the embodiment, the front and rear direction corresponds to a rotation axis direction of the fixing belt 21. The fixing belt 21 is formed in a cylindrical shape elongated in the front and rear direction and is endless in a circumferential direction. The fixing belt 21 has flexibility. The fixing belt 21 has, for example, an external diameter of 20 mm-50 mm.

The fixing belt 21 is composed of, for example, a base material layer, an elastic layer provided around the base material layer and a release layer covering the elastic layer. The base material layer of the fixing belt 21 is, for example, made of nickel (Ni) with a thickness of 30 μm-50 μm or made of polyimide resin with a thickness of 50 μm-100 μm. In a case making the base material layer of the fixing belt 21 by polyimide resin, polyimide resin may be mixed with metal powder, such as copper (Cu), silver (Ag) or aluminum (Al). The elastic layer of the fixing belt 21 is made of, for example, a silicone rubber with a thickness of 100 μm-500 μm. The release layer of the fixing belt 21 is made of, for example, fluorine-based resin, such as perfluoro alkoxy alkane (PFA), with a thickness of 30 μm-50 μm. Each figure shows the respective layers (the base material layer, the elastic layer and the release layer) of the fixing belt 21 without distinguishing.

On the inner circumferential face of the fixing belt 21, a coating made of polyimide, polyamidimide, polytetrafluoroethylene (PTFE) or the like is applied to a part to be slid with respect to the sheet member 26. On the inner circumferential face of the fixing belt 21, lubricant made of fluorine grease, a silicone oil or the like is applied to a part to be slid with respect to the sheet member 26.

The pressuring roller 22 is rotatably supported by a fixing frame (not shown). The pressuring roller 22 is formed in a cylindrical shape elongated in the front and rear direction. The pressuring roller 22 comes into pressure contact with the fixing belt 21, and thereby, between the fixing belt 21 and the pressuring roller 22, a fixing nip 33 is formed.

The pressuring roller 22 is composed of, for example, a cylindrical core material 34, an elastic layer 35 provided around the core material 34 and a release layer (not shown) covering the elastic layer 35. The core material 34 of the pressuring roller 22 is made of, e.g. metal, such as stainless steel or aluminum. The elastic layer 35 of the pressuring roller 22 is made of, for example, a silicone rubber or a silicone sponge. The release layer (not shown) of the pressuring roller 22 is made of, for example, fluorine-based resin, such as PFA.

As shown in FIG. 2 or other figures, the excitation coil 23 is arranged in an arc shape along an outer circumference of the fixing belt 21. The excitation coil 23 covers an upper side (an opposite side to the fixing nip 33) of the fixing belt 21.

The supporting member 24 is extending in the front and rear direction and penetrates the fixing belt 21. The supporting member 24 includes a fixing part 36 and front and rear shaft parts 37 (only the front shaft part 37 is shown in FIG. 3) arranged at both front and rear sides of the fixing part 36, respectively. An inner side end part in the front and rear direction of each shaft part 37 is connected with the fixing part 36. To an outer side part in the front and rear direction of each shaft part 37, an annular stopper 38 is fixed. An outer side end part in the front and rear direction of each shaft part 37 is fixed to the fixing frame (not shown).

The pressing pad 25 is extending in the front and rear direction. The pressing pad 25 is made of, for example, a heat resistant resin, such as liquid crystal polymer (LCP). A lower face (a face at the sheet member side) of the pressing pad 25 may have an elastomer layer, such as silicone rubber. The pressing pad 25 is supported by the fixing part 36 of the supporting member 24 from an upper side. The pressing pad 25 presses the fixing belt 21 to a lower side (to a side of the pressuring roller 22) via the sheet member 26.

The sheet member 26 is provided between the fixing belt 21 and the pressing pad 25 to come into contact with the inner circumferential face of the fixing belt 21. When the fixing belt 21 is rotated, the fixing belt 21 is slid with respect to the sheet member 26. The sheet member 26 is made of, for example, fluorine-based resin, such as PTFE, to have a friction coefficient smaller than that of the pressing pad 25. The sheet member 26 has a function to reduce a sliding load of the fixing belt 21.

The moving member 27 is extending in the front and rear direction. The moving member 27 is made of a metal, such as SUS, and is curved in an arc shape along an inner circumferential face of the fixing belt 21. The moving member 27 is rotatable along the inner circumferential face of the fixing belt 21 between a first position (see a solid line in FIG. 2) where the moving member 27 does not face the excitation coil 23 through the fixing belt 21, and a second position (see a two-dot chain line) where the moving member 27 partially faces the excitation coil 23 through the fixing belt 21. The moving member 27 is arranged farther away from the fixing nip 33 in a state that the moving member 27 is in the second position than a state that the moving member 27 is in the first position.

The driving mechanism 28 includes a coil spring 40 (biasing member) and a solenoid 41 (a holding member). The coil spring 40 is connected with the moving member 27, and biases the moving member 27 to the second position (see the two-dot chain line in FIG. 2). The solenoid 41 is connected with the moving member 27. In addition, the solenoid 41 is schematically shown in FIG. 2, and a position of the solenoid 41 in FIG. 2 and an actual position of the solenoid 41 do not necessarily match.

Figure 4:
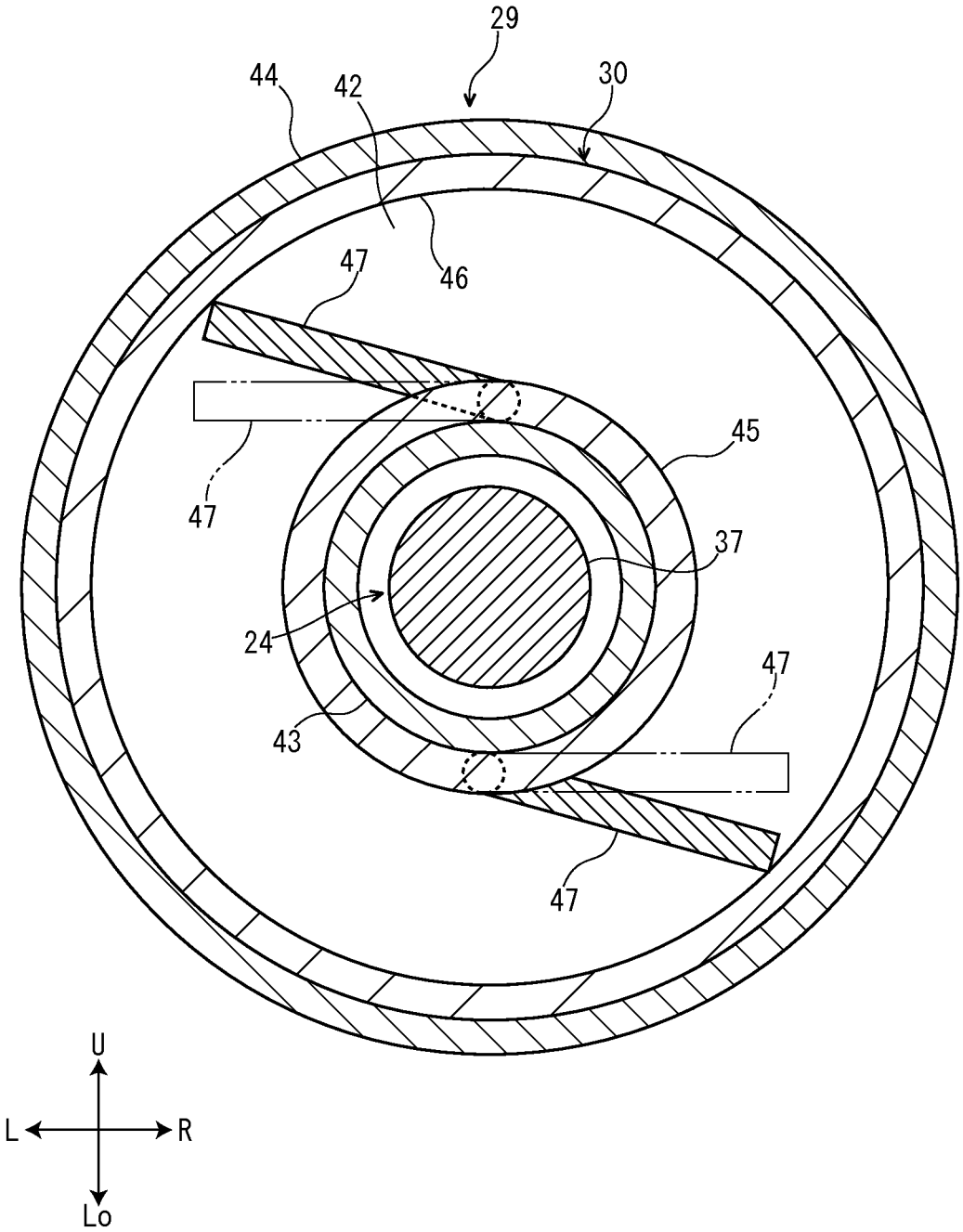
FIG. 4 is a sectional view showing a section along a line IV-IV of FIG. 3.

As shown in FIGS. 3 and 4, each bias stopping member 29 includes an annular main body part 42, an inner cylinder part 43 which extends from an end part at an inner diameter side of the main body part 42 to an inside in the front and rear direction, and an outer cylinder part 44 which extends from an end part at an outer diameter side of the main body part 42 to the inside in the front and rear direction.

The main body part 42 of each bias stopping member 29 covers the outside in the front and rear direction of the both front and rear end parts 21*a* of the fixing belt 21. An outside face in the front and rear direction of the main body part 42 is in contact with the stopper 38 fixed to each shaft part 37 of the supporting member 24. According to this configuration, a bias (meandering) of the fixing belt 21 in the front and rear direction is prevented.

The inner cylinder part 43 of each bias stopping member 29 is provided at an inner diameter side of the both front and rear end parts 21*a* of the fixing belt 21, and faces an inner circumferential face of the both front and rear end parts 21*a* of the fixing belt 21 at an interval. Each shaft part 37 of the supporting member 24 penetrates the inner cylinder part 43.

The outer cylinder part 44 of each bias stopping member 29 is provided at an outer diameter side of the inner cylinder part 43 of each bias stopping member 29 and the both front and rear end parts 21*a* of the fixing belt 21, and is in contact with the outer circumferential face of the both front and rear end parts 21*a* of the fixing belt 21.

As shown in FIGS. 3 and 4, the switching mechanism 30 includes an inner ring part 45, an outer ring part 46 which is provided at an outer diameter side of the inner ring part 45 and switching pieces 47 which are attached to the inner ring part 45.

The inner ring part 45 and the outer ring part 46 of the switching mechanism 30 are provided at an interval from each other. The inner ring part 45 is attached to an outer circumference of the inner cylinder part 43 of the front bias stopping member 29. The outer ring part 46 is attached to an inner circumference of the outer cylinder part 44 of the front bias stopping member 29. The outer ring part 46 is arranged at an outside in the front and rear direction of the both front and rear end parts 21*a* of the fixing belt 21.

Each switching piece 47 of the switching mechanism 30 is made of a thin metal, for example. Each switching piece 47 is in contact with the inner ring part 45 at all times. Each switching piece 47 is rotatable around the end part at an inner ring part 45 side. Each switching piece 47 is switchable between a connecting posture (see solid lines in FIG. 4) where each switching piece 47 comes into contact with the outer ring part 46 and connects the inner ring part 45 and the outer ring part 46, and a disconnecting posture (see two-dot chain lines in FIG. 4) where each switching piece 47 is not in contact with the outer ring part 46 and disconnects the inner ring part 45 and the outer ring part 46.

Figure 5:
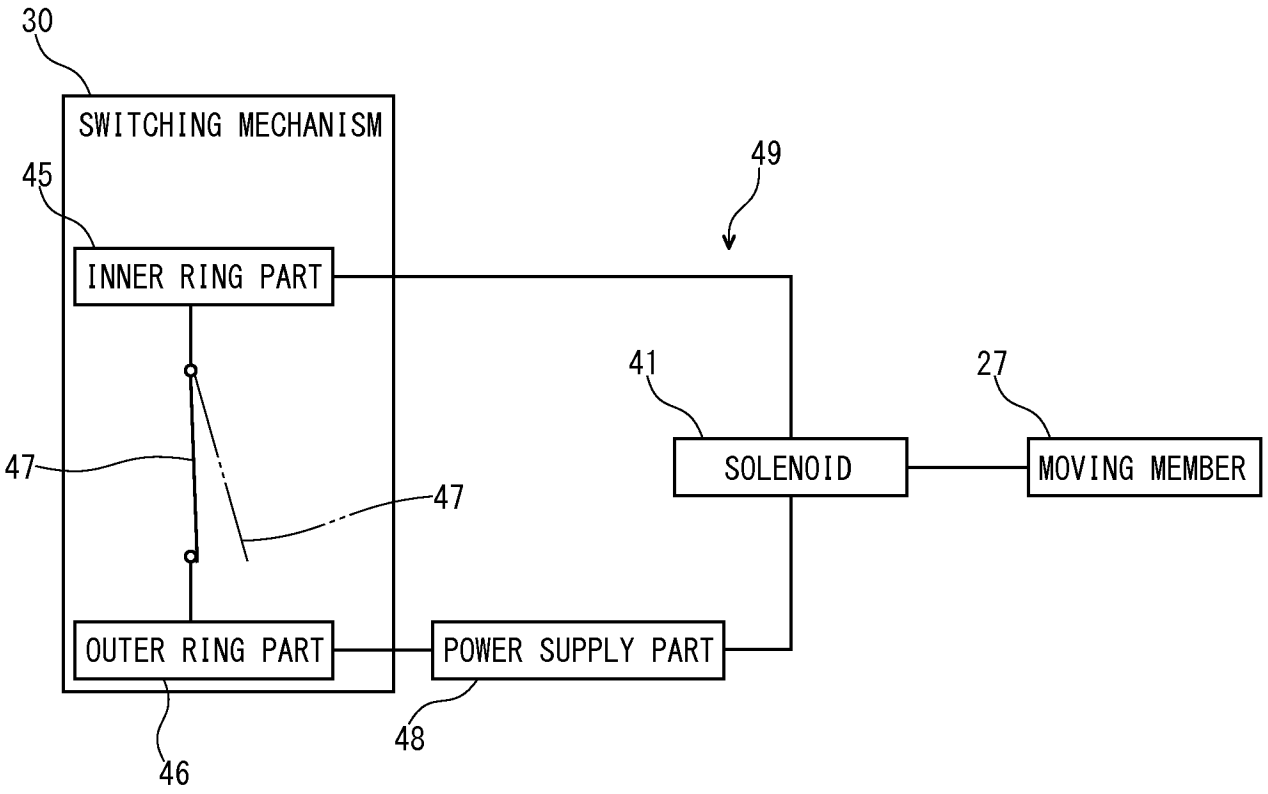
FIG. 5 is a schematic view showing a driving circuit of a moving member in the fixing device according to the embodiment of the present disclosure.

As shown in FIG. 5, the inner ring part 45 of the switching mechanism 30 is connected with the solenoid 41. The outer ring part 46 of the switching mechanism 30 is connected with the solenoid 41 via a power supply part 48. According to this configuration, the switching mechanism 30 composes a driving circuit 49 for the moving member 27 with the solenoid 41 and the power supply part 48.

Next, a controlling system of the fixing device 18 will be described.

Figure 6:
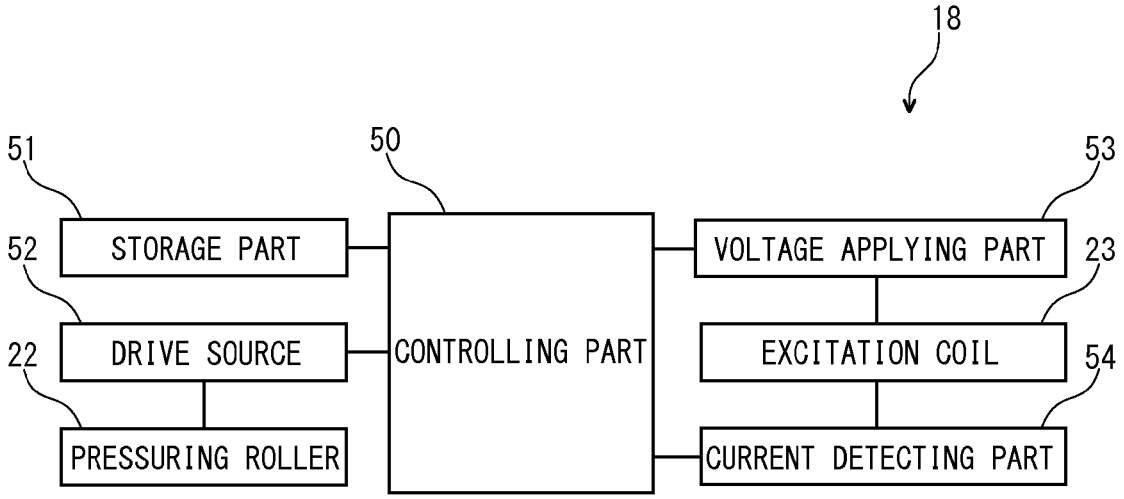
FIG. 6 is a block diagram showing the fixing device according to the embodiment of the present disclosure.

As shown in FIG. 6, the fixing device 18 includes a controlling part 50. The controlling part 50 is connected with a storage part 51 which is composed of a storage device, such as a ROM, a RAM or the like, and the controlling part 50 is configured to control each part of the fixing device 18 based on a control program or control data stored in the storage part 51.

The controlling part 50 is connected with a drive source 52 composed of a motor or the like, and the drive source 52 is connected with the pressuring roller 22. Further, the drive source 52 is configured to rotate the pressuring roller 22 based on a signal from the controlling part 50.

The controlling part 50 is connected with a voltage applying part 53. The voltage applying part 53 is connected with the excitation coil 23, and the voltage applying part 53 applies a heating voltage Vh for heating the fixing belt 21, to the excitation coil 23. The excitation coil 23 is connected with a current detecting part 54, and the current detecting part 54 is connected with the controlling part 50. Further, the current detecting part 54 is configured to detect a current flowing through the excitation coil 23, and output a detection result to the controlling part 50.

With regard to the fixing device 18 applying the above-described configuration, when a toner image is fixed to a sheet, the drive source 52 rotates the pressuring roller 22 based on a signal from the controlling part 50 (see arrow B in FIG. 2). According to this, the fixing belt 21 which comes into pressure contact with the pressuring roller 22 is co-rotated with rotation of the pressuring roller 22 (see arrow C in FIG. 2).

Further, the voltage applying part 53 applies the heating voltage Vh to fix the toner image on the sheet to the excitation coil 23 based on a signal from the controlling part 50. According to this, the excitation coil 23 produces a magnetic field, and a function of this magnetic field produces an eddy current in the fixing belt 21 and the fixing belt 21 generates heat. That is, the fixing belt 21 is heated by the excitation coil 23. When the sheet passes through the fixing nip 33 in this state, the sheet and the toner image are heated and pressured, and the toner image is fixed to the sheet.

When the fixing device 18 applying the above-described configuration repeats an operation of fixing toner images to sheets, the fixing belt 21 and the sheet member 26 slide against each other, then the sheet member 26 is worn away and a sliding load of the fixing belt 21 increases. Further, a surface of the fixing belt 21 and a surface of the pressuring roller 22 gradually deteriorate, and drive force of the fixing belt 21 (a co-rotational property of the fixing belt 21 with respect to the pressuring roller 22) lowers. When these factors cause a slip between the pressuring roller 22 and the fixing belt 21, there is a fear that the fixing belt 21 cannot be co-rotated with rotation of the pressuring roller 22, and the fixing belt 21 in a rotation stop state is locally heated by the excitation coil 23. When such a situation occurs, there is a fear that a temperature of a part of the fixing belt 21 is rapidly raised, and the fixing belt 21 is deformed. Hence, in the embodiment, the fixing belt 21 in the rotation stop state is prevented from being locally heated by the excitation coil 23 as follows.

When the fixing belt 21 is rotated, as indicated by the solid lines in FIG. 4, centrifugal force generated by rotation of the fixing belt 21 holds the switching pieces 47 of the switching mechanism 30 to the connecting posture. According to this, as indicated by the solid line in FIG. 5, the driving circuit 49 of the moving member 27 is connected, and electric power is supplied to the solenoid 41 by the power supply part 48. Hence, as indicated by the solid lines in FIG. 2, the solenoid 41 holds the moving member 27 in the first position against the biasing force of the coil spring 40, and the moving member 27 does not face the excitation coil 23 through the fixing belt 21. An electric resistance of the excitation coil 23 in this state is a first resistance value R1. When the voltage applying part 53 applies the heating voltage Vh to the excitation coil 23 in this state, current of a first value I1 flows through the excitation coil 23, and this first value I1 is detected by the current detecting part 54 and is outputted to the controlling part 50.

By contrast with this, when a rotation of the fixing belt 21 is stopped, the centrifugal force generated by the rotation of the fixing belt 21 is lost, and therefore, as indicated by the two-dot chain lines in FIG. 4, the switching pieces 47 of the switching mechanism 30 switches from the connecting posture to the disconnecting posture. According to this, as indicated by the two-dot chain line in FIG. 5, the driving circuit 49 of the moving member 27 is broken, and the supply of the electric power to the solenoid 41 by the power supply part 48 is stopped. Hence, the holding of the moving member 27 to the first position by the solenoid 41 is released, so that, as indicated by the two-dot chain line in FIG. 2, the biasing force of the coil spring 40 moves the moving member 27 from the first position to the second position and the moving member 27 partially faces the excitation coil 23 through the fixing belt 21. According to this, an electrical resistance of the excitation coil 23 becomes a second resistance value R2 higher than the first resistance value R1. When the voltage applying part 53 applies the heating voltage Vh to the excitation coil 23 in this state, the current of the second value I2 which is lower than the first value I1 flows through the excitation coil 23, and this second value I2 is detected by the current detecting part 54 and is outputted to the controlling part 50.

When the current detected by the current detecting part 54 changes from the first value I1 to the second value I2, the controlling part 50 determines that the rotation of the fixing belt 21 has stopped, and stops the voltage applying part 53 from applying the heating voltage Vh to the excitation coil 23. According to this, the excitation coil 23 also stops heating the fixing belt 21.

In addition, when the fixing belt 21 is rotated again, the centrifugal force generated by the rotation of the fixing belt 21 switches the switching pieces 47 of the switching mechanism 30 from the disconnecting posture to the connecting posture, the driving circuit 49 of the moving member 27 is connected, and power is supplied to the solenoid 41 by the power supply part 48. Hence, against the biasing force of the coil spring 40, the solenoid 41 rotates the moving member 27 from the second position to the first position.

In the present embodiment, as described above, in conjunction with a change of a value of current detected by the current detecting part 54 from the first value I1 to the second value I2 in a state that the voltage applying part 53 applies the heating voltage Vh to the excitation coil 23, the controlling part 50 stops the voltage applying part 53 from applying the heating voltage Vh to the excitation coil 23. By applying this configuration, it is possible to reliably prevent the excitation coil 23 from locally heating the fixing belt 21 in the rotation stop state. Consequently, it is possible to reliably prevent a failure that the temperature of the part of the fixing belt 21 is rapidly raised, and the fixing belt 21 is deformed.

Further, in conjunction with a rotation stop of the fixing belt 21, holding of the moving member 27 in the first position by the solenoid 41 is released, so that the biasing force of the coil spring 40 moves the moving member 27 from the first position to the second position. By applying this configuration, in conjunction with the rotation stop of the fixing belt 21, it is possible to reliably move the moving member 27 from the first position to the second position.

Further, in conjunction with the rotation stop of the fixing belt 21, the driving circuit 49 of the moving member 27 is broken by the switching mechanism 30, supply of electric power to the solenoid 41 by the power supply part 48 is stopped, and holding of the moving member 27 in the first position by the solenoid 41 is released. By applying this configuration, in conjunction with the rotation stop of the fixing belt 21, it is possible to reliably release the holding of the moving member 27 in the first position by the solenoid 41.

Further, in conjunction with the rotation stop of the fixing belt 21, the centrifugal force generated by the rotation of the fixing belt 21 is lost, and the switching pieces 47 are switched from the connecting posture to the disconnecting posture, so that the driving circuit 49 of the moving member 27 is broken. By applying this configuration, in conjunction with the rotation stop of the fixing belt 21, it is possible to reliably switch the switching pieces 47 from the connecting posture to the disconnecting posture.

Further, in the present embodiment, the bias stopping members 29 which restrict a bias of the fixing belt 21 in the front and rear direction is also used as an attachment part of the switching mechanism 30. Consequently, it is possible to prevent the number of members from increasing.

Further, the excitation coil 23 is provided on the outer diameter side of the fixing belt 21, and the moving member 27 is provided to rotate along the inner circumferential face of the fixing belt 21. By applying this configuration, it is possible to easily secure an arrangement space of the excitation coil 23 and the moving member 27.

Further, the moving member 27 is configured not to face the excitation coil 23 through the fixing belt 21 in the state of the first position, and partially face the excitation coil 23 through the fixing belt 21 in the state of the second position. By applying this configuration, an electric resistance of the excitation coil 23 in a state that the moving member 27 is in the second position is made higher than the electric resistance of the excitation coil 23 in a state that the moving member 27 is in the first position, a value of current which flows through the excitation coil 23 in a state that the moving member 27 is in the second position is made lower than a value of current which flows through the excitation coil 23 in a state that the moving member 27 is in the first position.

Further, the fixing device 18 includes the pressing pad 25 which presses the fixing belt 21 toward a lower side (a pressuring roller 22 side). By applying this configuration, it is possible to lower a heat capacity of the fixing device 18.

In the embodiment, the moving member 27 partially faces the excitation coil 23 through the fixing belt 21 in the state that the moving member 27 is in the second position. In another embodiment, a whole part of the moving member 27 may face the excitation coil 23 through the fixing belt 21 in the state that the moving member 27 is in the second position.

In the embodiment, the excitation coil 23 is arranged at the outer diameter side of the fixing belt 21, and the moving member 27 is rotated along the inner circumferential face of the fixing belt 21. In another embodiment, the excitation coil 23 may be arranged at an inner diameter side of the fixing belt 21, and the moving member 27 may be rotated along an outer circumferential face of the fixing belt 21

In the embodiment, driving force is input to the pressuring roller 22 from the drive source 52. In another embodiment, driving force may be input to the fixing belt 21 from the drive source 52 or driving force may be input to both of the fixing belt 21 and the pressuring roller 22 from the drive source 52.

In the embodiment, the excitation coil 23 is used as a heating member. In another embodiment, a heater, such as a halogen heater or a ceramic heater or the like, may be used as a heating member.

In the embodiment, the configuration of the present disclosure is applied to the fixing device 18 with a manner to press the fixing belt 21 to the lower side (to the side of the pressuring roller 22) by the pressing pad 25. In another embodiment, the configuration of the present disclosure may be applied to the fixing device 18 with a manner to rotate the fixing belt 21 together with one or more rollers arranged at the inner diameter side of the fixing belt 21.

In the embodiment, the configuration of the present disclosure is applied to the printer 1. In another embodiment, the configuration of the present disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt configured to be rotatable around a rotation axis;

a pressuring member configured to come into pressure contact with the fixing belt so as to form a fixing nip;

a heating member configured to heat the fixing belt;

a voltage applying part configured to apply a heating voltage for heating the fixing belt to the heating member;

a current detecting part configured to detect current flowing through the heating member;

a moving member configured to be movable between a first position where the current flowing through the heating member becomes a first value in a state that the voltage applying part applies the heating voltage to the heating member and a second position where the current flowing through the heating member becomes a second value in the state that the voltage applying part applies the heating voltage to the heating member;

a driving mechanism configured to move the moving member from the first position to the second position in conjunction with a rotation stop of the fixing belt; and a controlling part configured to stop the voltage applying part from applying the heating voltage to the heating member in conjunction with a change of the current detected by the current detecting part from the first value to the second value in the state that the voltage applying part applies the heating voltage to the heating member, wherein the driving mechanism includes:

a biasing member configured to bias the moving member to the second position; and a holding member configured to hold the moving member in the first position against biasing force of the biasing member, wherein holding of the moving member in the first position by the holding member is released in conjunction with the rotation stop of the fixing belt so that the moving member moves from the first position to the second position by the biasing force of the biasing member.

2. The fixing device according to claim 1, further comprising:

a power supply part configured to supply electric power to the holding member; and a switching mechanism configured to compose a driving circuit for the moving member with the holding member and the power supply part, wherein the switching mechanism breaks the driving circuit in conjunction with the rotation stop of the fixing belt and supply of the electric power to the holding member by the power supply part is stopped so that the holding of the moving member in the first position by the holding member is released.

3. The fixing device according to claim 2, wherein the switching mechanism includes:

an inner ring part and an outer ring part arranged at an interval from each other; and a switching piece configured to be switchable between a connecting posture to connect the inner ring part and the outer ring part and a disconnecting posture to disconnect the inner ring part and the outer ring part, the switching piece being held to the connecting posture by centrifugal force generated by rotation of the fixing belt, wherein the centrifugal force is lost in conjunction with the rotation stop of the fixing belt and the switching piece is switched from the connecting posture to the disconnecting posture so that the driving circuit is broken.

4. The fixing device according to claim 3, further comprising a bias stopping member attached to an end part of the fixing belt and configured to stop a bias in the rotation axis direction of the fixing belt, wherein the bias stopping member includes:

a main body part configured to cover an outside in the rotation axis direction of the end part of the fixing belt;

an inner cylinder part configured to extend from the main body part toward an inside in the rotation axis direction and arranged at an inner diameter side of the end part of the fixing belt; and an outer cylinder part configured to extend from the main body part toward an inside in the rotation axis direction and arranged at an outer diameter side of the end part of the fixing belt, the inner ring part is attached to an outer circumference of the inner cylinder part and the outer ring part is attached to an inner circumference of the outer cylinder part, the switching piece comes into contact with the inner ring part and is rotatable around an end part in the inner ring part side of the switching piece.

5. The fixing device according to claim 1, wherein the moving member is arranged farther away from the fixing nip in a state that the moving member is in the second position than a state that the moving member is in the first position.

6. The fixing device according to claim 1, further comprising a pressing member configured to press the fixing belt toward the pressuring member side.

7. An image forming apparatus comprising the fixing device according to claim 1.

8. A fixing device comprising:

a fixing belt configured to be rotatable around a rotation axis;

a pressuring member configured to come into pressure contact with the fixing belt so as to form a fixing nip;

a heating member configured to heat the fixing belt;

a voltage applying part configured to apply a heating voltage for heating the fixing belt to the heating member;

a current detecting part configured to detect current flowing through the heating member;

a moving member configured to be movable between a first position where the current flowing through the heating member becomes a first value in a state that the voltage applying part applies the heating voltage to the heating member and a second position where the current flowing through the heating member becomes a second value in the state that the voltage applying part applies the heating voltage to the heating member;

a driving mechanism configured to move the moving member from the first position to the second position in conjunction with a rotation stop of the fixing belt; and a controlling part configured to stop the voltage applying part from applying the heating voltage to the heating member in conjunction with a change of the current detected by the current detecting part from the first value to the second value in the state that the voltage applying part applies the heating voltage to the heating member, wherein the heating member is an excitation coil arranged at an outer diameter side of the fixing belt, and the moving member rotates between the first position and the second position along an inner circumferential face of the fixing belt,and wherein the moving member is curved in an arc shape along the inner circumferential face of the fixing belt.

9. The fixing device according to claim 8, wherein the moving member does not face the excitation coil through the fixing belt in a state that the moving member is in the first position, and the moving member at least partially faces the excitation coil through the fixing belt in a state that the moving member is in the second position.

* * * * *